US006322410B1

(12) United States Patent
Harvey

(10) Patent No.: US 6,322,410 B1
(45) Date of Patent: Nov. 27, 2001

(54) WATER COOLED ELECTRIC FUEL PUMP FOR MARINE PROPULSION

(75) Inventor: Richard W. Harvey, Logansport, IN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/307,665

(22) Filed: May 10, 1999

(51) Int. Cl.[7] ..... B63H 21/10
(52) U.S. Cl. ..... 440/88
(58) Field of Search ..... 123/41.31; 440/88

(56) References Cited

U.S. PATENT DOCUMENTS

| | | | |
|---|---|---|---|
| 3,835,822 | 9/1974 | Mickle et al. | 123/41.31 |
| 4,728,306 | 3/1988 | Schneider . | |
| 5,438,962 | 8/1995 | Iwata et al. | 123/41.31 |
| 5,555,855 | 9/1996 | Takahashi | 123/41.08 |
| 5,647,331 | 7/1997 | Swanson . | |
| 5,803,036 * | 9/1998 | Takahashi et al. | 123/179.25 |

* cited by examiner

*Primary Examiner*—Ed Swinehart
(74) *Attorney, Agent, or Firm*—Baker & Daniels

(57) ABSTRACT

A fuel pump (14) is driven by a marine engine (12) for pumping fuel from a fuel tank (16) to the internal combustion engine (12). A cooling jacket (18) is disposed about the fuel pump (14) and is in sealing engagement with the fuel pump (14) to form a cooling chamber (20) about the fuel pump (14). The cooling jacket (18) has a water inlet (22) for admitting cooling water to the cooling chamber (20). A water pump (24) is driven by the engine (12) for supplying environmental water to the water inlet (22) of the cooling jacket (18). A pickup (26) is connected to the water pump (24) for supplying environmental marine water to the water pump (24), i.e., the pickup (26) is disposed in the water in which the watercraft is buoyed. The cooling jacket (18) has a water outlet (28) for dumping water from the cooling chamber (20) back to the environmental marine water, i.e., the water outlet (28) is disposed to dump cooling water into the same water in which the watercraft is buoyed.

3 Claims, 1 Drawing Sheet

WATER COOLED ELECTRIC FUEL PUMP FOR MARINE PROPULSION

BACKGROUND OF THE INVENTION

1. Field of the Invention

The subject invention relates to a marine propulsion system in which the supply of fuel is cooled to prevent fuel vapors by cooling the fuel pump.

2. Description of the Prior Art

It is well known in the art to cool the fuel pump which supplies fuel to an engine of a watercraft. An example of such a system is disclosed in U.S. Pat. No. 5,438,962 to Iwata et al. Other systems are disclosed in U.S. Pat. No. 3,835,822 to Mickle et al and U.S. Pat. No. 5,555,855 to Takahashi. These systems teach the cooling of the fuel by use of cooling water which is commingled with the cooling water for the engine.

SUMMARY OF THE INVENTION AND ADVANTAGES

The invention involves the cooling of a fuel pump for a marine engine in a watercraft disposed in environmental water by pumping water from the environmental water in which the watercraft is disposed with power from the marine engine and directing the water around the fuel pump as cooling water and thereafter dumping the cooling water from the fuel pump back to the environmental water.

Accordingly, the subject invention provides a unique jacketed fuel pump for maximizing cooling in a marine propulsion engine and the concept of using the environmental water independently of the cooling water for the engine.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
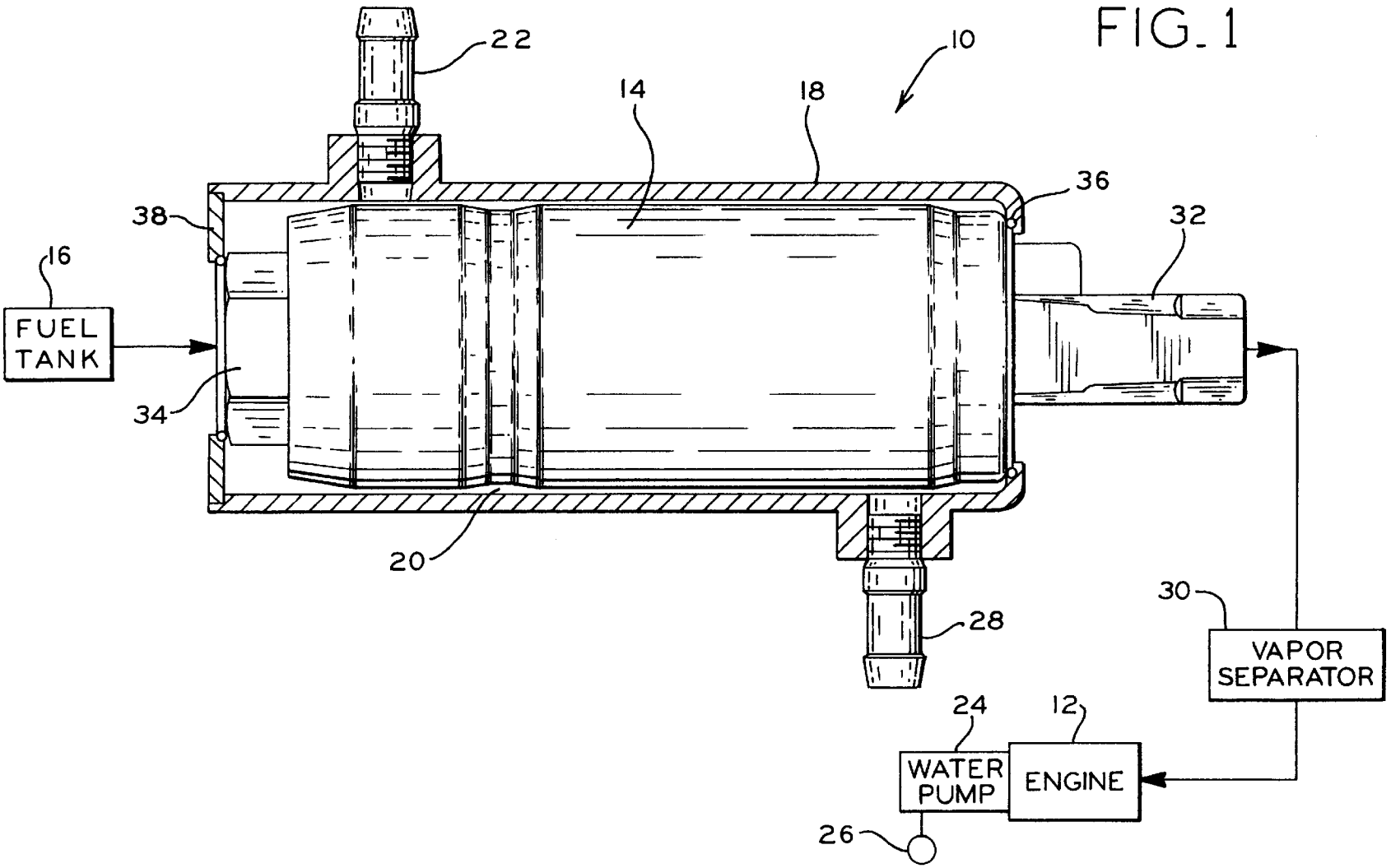
FIG. 1 is a schematic view.

Referring to the drawing, a marine propulsion assembly is generally shown at 10 in FIG. 1.

The assembly 10 includes an internal combustion engine 12. A fuel pump 14 is driven by the engine 12 for pumping fuel from a fuel tank 16 to the internal combustion engine 12.

A cooling jacket 18 is disposed about the fuel pump 14 and is in sealing engagement with the fuel pump 14 to form a cooling chamber 20 about the fuel pump 14. The cooling jacket 18 has a water inlet 22 or 28 for admitting cooling water to the cooling chamber 20.

A water pump 24 is driven by the engine 12 for supplying environmental water to the water inlet 22 or 28 of the cooling jacket 18. A pickup 26 is connected to the water pump 24 for supplying environmental marine water to the water pump 24, i.e., the pickup 26 is disposed in the water in which the watercraft is buoyed.

The cooling jacket 18 has a water outlet 28 or 22 for dumping water from the cooling chamber 20 back to the environmental marine water, i.e., the water outlet 28 or 22 is disposed to dump cooling water into the same water in which the watercraft is buoyed. However, this dumping water could cool other devices before actually being dumped into the environmental water.

In order to drain the cooling jacket 18 during shutdown, the water outlet 28 or 22 is disposed on the bottom of the cooling jacket 18 for draining the cooling jacket 18 under the force of gravity.

The fuel pump 14 extends longitudinally along an axis between first and second ends, i.e., a first end having a fuel outlet 32 and a second end having a fuel inlet 34. The jacket 18 extends in a cylinder around the longitudinal axis of the fuel pump 14 between the first and second ends thereof. The jacket 18 includes radially extending lips 36 and 38 at each end thereof in sealing engagement with the ends of the fuel pump 14. The jacket 18 comprises an integral member extending cylindrically around the fuel pump 14 between the ends thereof and including one 36 of the lips at the first end, i.e., an integral lip 36. The other 38 of the lips is defined by an independent washer-like element secured to the integral element at the second end thereof, e.g., as by an adhesive defining a water tight joint. The jacket 18 preferably consists of a thermally conductive material, as a non-metallic material.

The invention therefore includes a method of cooling a fuel pump 14 for a marine engine 12 in a watercraft disposed in environmental water which comprises the steps of pumping water from the environmental water in which the watercraft is disposed with power from the marine engine 12 and directing the water around the fuel pump 14 as cooling water, while dumping the cooling water from the fuel pump 14 back to the environmental water.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A marine propulsion assembly comprising:

an internal combustion engine;

an elongated fuel pump for pumping fuel from a fuel tank to said internal combustion engine, said pump extends longitudinally along an axis between first and second ends, said pump oriented with its longitudinal axis in a substantially horizontal position;

a cooling jacket disposed about said pump and in sealing engagement with said pump to form a cooling chamber about said pump, said jacket including a radially extending lip at each end thereof in sealing engagement with said ends of said fuel pump, wherein said jacket extends around the longitudinal axis of said fuel pump between said ends thereof;

a water inlet in said cooling jacket for admitting cooling water to said cooling chamber;

a water pump driven by said engine for supplying water to said water inlet of said cooling jacket;

a pickup connected to said water pump for supplying environmental marine water to said water pump;

a vapor separator disposed between said fuel pump and said engine; and said cooling jacket having a water outlet disposed on the bottom of said cooling jacket for dumping water from said cooling chamber back to said environmental marine water.

2. A marine propulsion assembly comprising:

an internal combustion engine;

an elongated fuel pump for pumping fuel from a fuel tank to said internal combustion engine, said pump extends longitudinally along an axis between first and second ends, said pump oriented with its longitudinal axis in a substantially horizontal position;

a cooling jacket disposed about said pump and in sealing engagement with said pump to form a cooling chamber about said pump, said jacket including a radially extending lip at each end thereof in sealing engagement with said ends of said fuel pump, said jacket comprising an integral member extending around said fuel pump between said ends thereof and including one of said lips at said first end, wherein said jacket extends around the longitudinal axis of said fuel pump between said ends thereof;

a water inlet in said cooling jacket for admitting cooling water to said cooling chamber;

a water pump driven by said engine for supplying water to said water inlet of said cooling jacket;

a pickup connected to said water pump for supplying environmental marine water to said water pump;

a vapor separator disposed between said fuel pump and said engine; and said cooling jacket having a water outlet disposed on the bottom of said cooling jacket for dumping water from said cooling chamber back to said environmental marine water.

3. A marine propulsion assembly comprising:

an internal combustion engine;

an elongated fuel pump for pumping fuel from a fuel tank to said internal combustion engine, said pump extends longitudinally along an axis between first and second ends, said pump oriented with its longitudinal axis in a substantially horizontal position;

a cooling jacket disposed about said pump and in sealing engagement with said pump to form a cooling chamber about said pump, said jacket including a radially extending lip at each end thereof in sealing engagement with said ends of said fuel pump, said jacket comprising an integral member extending around said fuel pump between said ends thereof and including one of said lips at said first end, the other of said lips defined by an independent element secured to said integral element at said second end thereof, wherein said jacket extends around the longitudinal axis of said fuel pump between said ends thereof;

a water inlet in said cooling jacket for admitting cooling water to said cooling chamber;

a water pump driven by said engine for supplying water to said water inlet of said cooling jacket;

a pickup connected to said water pump for supplying environmental marine water to said water pump;

a vapor separator disposed between said fuel pump and said engine; and said cooling jacket having a water outlet disposed on the bottom of said cooling jacket for dumping water from said cooling chamber back to said environmental marine water.

* * * * *